US005967064A

United States Patent [19]

Keldenich et al.

[11] Patent Number: 5,967,064

[45] **Date of Patent: *Oct. 19, 1999**

[54] ROLLER GRATE

[75] Inventors: Kai Keldenich, Essen; Jurgen Scheffler; Peter Grell, both of Oberhausen; Othmar Frielingsdorf, Hofheim am Taunus, all of Germany; Colin Peter Robson, New Malden, United Kingdom

[73] Assignee: Deutsche Babcock Anlagen GmbH, Oberhausen, Germany

[ * ] Notice: This patent is subject to a terminal disclaimer.

[21] Appl. No.: 08/945,396

[22] PCT Filed: Mar. 7, 1996

[86] PCT No.: PCT/EP96/00974

§ 371 Date: Nov. 7, 1997

§ 102(e) Date: Nov. 7, 1997

[87] PCT Pub. No.: WO96/29545

PCT Pub. Date: Sep. 26, 1996

[30] Foreign Application Priority Data

Mar. 21, 1995 [EP] European Pat. Off. ..... 95104112

[51] Int. Cl.[6] ..... F23H 9/02; F23H 1/02; F23N 5/20

[52] U.S. Cl. ..... 110/276; 110/192; 110/248; 110/268; 110/298; 110/300; 110/311; 126/152 R; 126/152 B; 126/163 R; 126/181

[58] Field of Search ..... 110/192, 248, 110/251, 255, 257, 297, 267, 268, 275, 276, 286, 309, 311, 312, 346, 348, 298, 299, 300; 126/152 R, 152 B, 163 R, 181

[56] References Cited

U.S. PATENT DOCUMENTS

| | | | |
|---|---|---|---|
| 2,367,590 | 1/1945 | Lewers et al. | 110/248 |
| 5,042,401 | 8/1991 | Ettehadieh | 110/275 X |
| 5,405,537 | 4/1995 | Goff et al. | 110/346 X |
| 5,448,957 | 9/1995 | Goldammer et al. | 110/275 X |

*Primary Examiner*—James C. Yeung
*Assistant Examiner*—Ljiljana V. Ciric
*Attorney, Agent, or Firm*—Max Fogiel

[57] ABSTRACT

A roller grate arrangement for garbage-incinerating plants, in which a plurality of rollers with horizontal and parallel axes lie in an inclined plane. Primary air is fed to interiors of the rollers by air boxes located below the grate. The rollers have surfaces with air gaps for supplying the primary air, and the rollers are positioned to form a space between adjacent rollers. A component in the space between adjacent rollers bridges the space between adjacent rollers. The component is free of air passages. Blast pipes are positioned in spaces between adjacent rollers and are connected to a separate system for feeding supplemental air.

13 Claims, 3 Drawing Sheets

ROLLER GRATE

BACKGROUND OF THE INVENTION

The point of departure of the roller grate of the present invention is the state of the art known from SU 1 756 741 A1. That document describes a roller grate wherein every intermediate component comprises a system of stationary bars with gaps between them. Accommodated below the intermediate components are air boxes. Air is supplied to the boxes by a fan that is independent of the primary-air system. The particular object is to improve burn-up.

A roller grate wherein air is blown into a nip or space between through bar-like intermediate components is also known from German Patent 600 546. The bar-like components are in two parts. The two are moved relative to one another and to the rollers by a cam. The motion is intended to poke the bed of fuel resting thereon. The intermediate components obtain their air from the adjacent rollers. The streams of air blown in by way of the intermediate components are accordingly component streams of the primary air.

As far as is known, the approaches suggested in these two documents have never been applied to garbage incinerators. The space between the adjacent rollers in the roller-grate combustion systems currently known and being built are bridged over by intermediate components in the form of slender strips, usually called strippers. Specific examples of such strips are described in German 3 420 020 C1 and German 4 300 636 C1 for instance. Supplemental air is not supplied to the nips or spaces between the rollers. All of the primary air supplied to the fuel bed arrives through the surfaces of the rollers.

The layer of fuel in the vicinity of the nip or spaces is considerably thicker than in the areas where it rests against the rollers. The fuel also has a tendency to become denser in the vicinity of the gaps, where there the material is finer. A lot of air is accordingly needed in these areas. The increased impedance offered by the garbage resting there on the other hand forces the primary air out of the nips and into the regions when the layer is thin and loose, at the edges of the grate for example.

SUMMARY OF THE INVENTION

The object of the present invention is to improve the roller grate in order to allow the fire to be poked and fanned in the vicinity of the nips.

This object is attained whereby jets of air blown into the vicinity of the nip increase the supply of oxygen and loosen the fuel bed, for improving the contact between the particles of fuel and the oxygen. The fire, fanned in this manner within the nip, is more intense and even acts as ignition for the garbage above it. It accelerates combustion and accordingly contributes to increasing the furnace's combustion output.

BRIEF DESCRIPTION OF THE DRAWINGS

One embodiment of the present invention will now be specified by way of example with reference to the accompanying simplified drawing, wherein.

DESCRIPTION OF THE PREFERRED EMBODIMENTS

Figure 1:
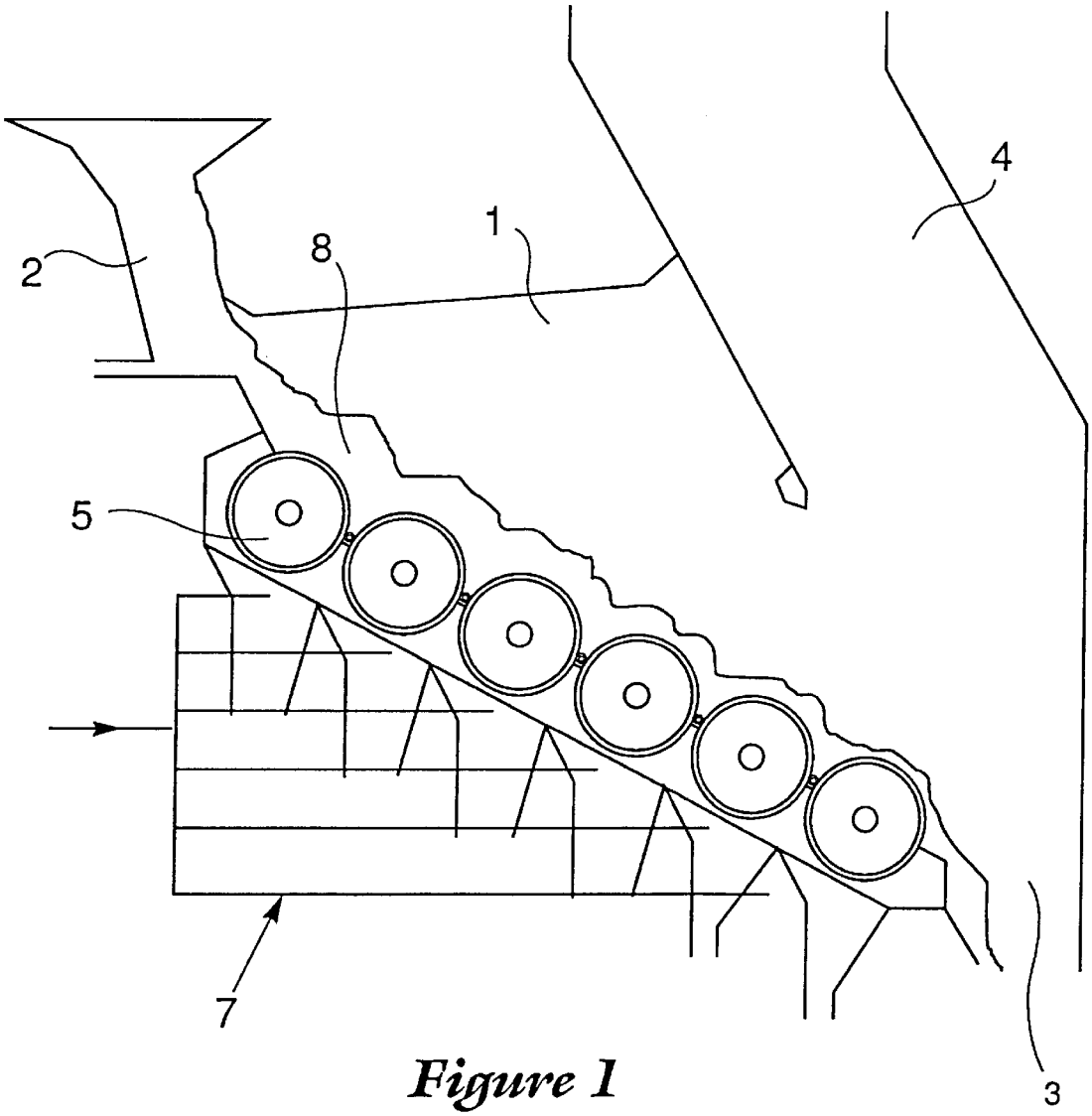
FIG. 1 is a schematic side view of a roller grate.
Figure 2:
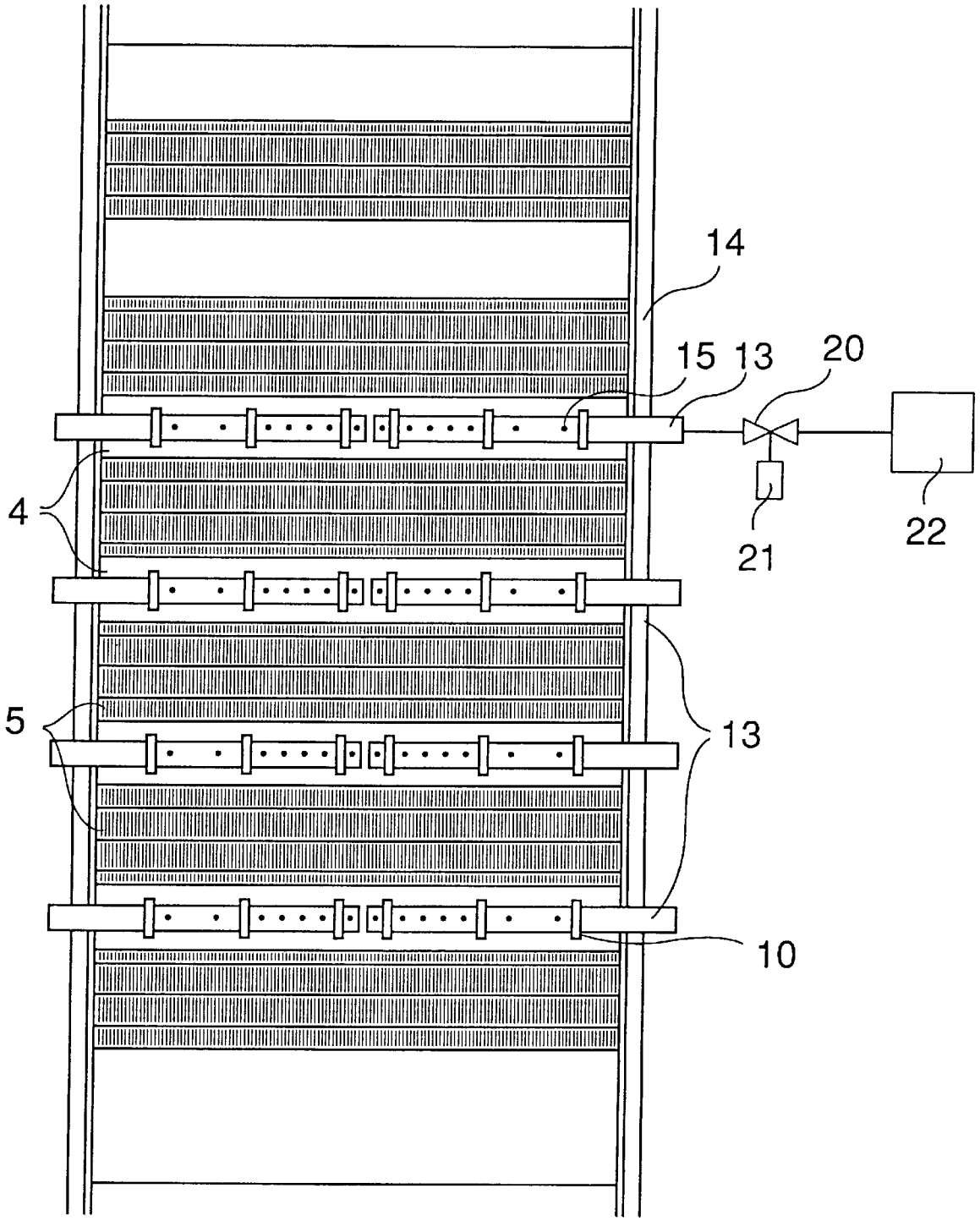
FIG. 2 is a top view of the same grate.
Figure 3:
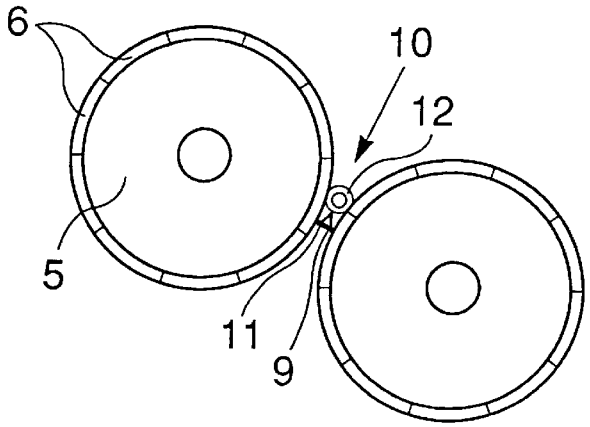
FIG. 3 is an enlarged detail of FIG. 1.

A furnace 1 in a garbage-incinerating plant illustrated in FIG. 1 is provided with a fueling hopper 2, an ash-removal shaft 3, and a flue-gas extractor 4. The floor of furnace 1 is in the form of a grate comprising six rollers 5 approximately 1.5 m in diameter. The axes of rollers 5 extend horizontal and parallel in a plane inclined approximately 20 to 30° down toward ash-removal shaft 3. The surface of rollers 5 consists, as will be evident from the figure, of bars 6, each extending along a curve of 36°, ten bars 6 accordingly constituting a closed ring. Each bar 6 is about 5 cm wide. Between each pair of adjacent bars 6 is a gap of approximately 2 to 3 mm. Each roller is rotated by a drive mechanism at a continuously variable speed of 0.6 to 12 rotations an hour. Below the grate is a system essentially consisting of air boxes 7 that supply primary air to rollers 5. The flow of primary air to each roller 5 can be separately controlled. The distribution of primary air to the rollers matches the need of each area of the grate. Most of it is supplied to the area of major combustion, in the vicinity of the second, third, and fourth rollers. Resting on rollers 5 is a schematically represented non-uniform layer 8 of fuel. The space between each pair of adjacent rollers 5 is narrow in comparison to the diameter of the rollers and bridged by a slender strip-shaped intermediate component 9. The diameter of each intermediate component 9 is approximately ⅕ to 1/10 that of the rollers. There is no way for air to get through.

The grate to the extent hereintofore described is state of the art.

Several separated holders 10 are secured to intermediate components 9. Each holder 10 comprises a foot 11 and a ring 12. Rings 12 loosely accommodate blast pipes 13. Each blast pipe 13 is made of heat-resistant steel and its diameter is between 20 and 120 mm. They extend more or less into the middle of the furnace through its lateral walls 14. Blast pipes 13 are closed at their free ends at the middle of the rollers. They are rotated around their longitudinal axes by an unillustrated mechanism outside the furnace. Distributed along each blast pipe 13 are several blast openings 15 that open upward vertically or at an angle. Each pair of openings is separated 50 to 1000 mm. The diameter of each opening is 2 to 20 mm. The ratio of diameter to distance ensures that the sum of the areas of the openings per meter of blast-pipe length is at least 0.5 $cm^2$ but no more than 10 $cm^2$ and preferably no more than 5 $cm^2$. Each blast pipe 13 in one preferred embodiment of the present invention is 2.5 m long and has ten openings, each 0.6 cm wide, uniformly distributed along it. The two blast pipes 13 accommodated in a single nip accordingly have a total blast cross-section of just 6 $cm^2$. The openings can, however, alternatively differ in width and/or be distributed at varying distances along the pipe. They can also be positioned at different locations in different pipes in the same grate. It will be practical for them to be arranged and dimensioned such that the width of the openings per m of blast pipe is greatest in the vicinity of the highest demand for oxygen, meaning at the middle of the rollers and especially in the nips between the second and third and between the third and fourth rollers. The pipes can be left out of the nips downstream of the first and between the fifth and sixth rollers.

Figure 4:
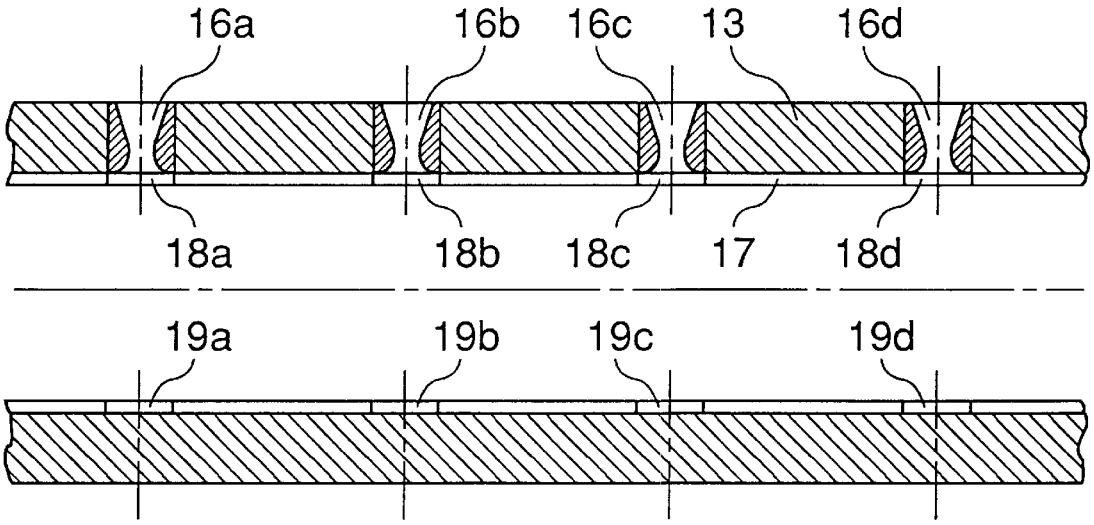
FIG. 4 is a section through part of a blast pipe.

The blast openings in the embodiment illustrated in FIG. 4 constitute Laval nozzles 16*a*–16*d*. An inner pipe 17 slides into and out of each blast pipe 13 in this embodiment and has several rows of openings 18*a*–18*d* and 19*a*–19*d* in its circumference. In the illustrated state, openings 18*a*–18*d* communicate with Laval nozzles 16*a*–16*d*. If, however, inner pipe 17 is rotated 180° around its axis, openings 19*a* and 19*b* will communicate with Laval nozzles 16*a* and 16*b*. Since openings 19*c* and 19*d* are displaced in relation to Laval nozzles 16*c* and 16*d*, the latter will be closed off in this state. Laval nozzles 16*a* and 16*b* can be blocked and Laval nozzles 16*c* and 16*d* opened by sliding inner pipe 17 back and forth inside blast pipe 13.

Blast pipes 13 communicate with a supplemental-air system through valves 20. Valves 20 are actuated by a timer 21. This system communicates with a reservoir of pure oxygen or oxygen-enriched air.

In operation, supplemental air, preferably heated and enriched with as much as 50% oxygen, is injected through blast pipes 13. Since the blast pipes are surrounded by garbage in the nips, the jets of air will reliably penetrate into the layer of garbage.

The device can be operated in various ways. When operated for example at a pressure whereat the speed of the flow of supplemental air is considerably below the speed of sound, it is practical to inject the supplemental air continuously. In this event the blast pipes 13 will be periodically pivoted back and forth to improve loosening.

The pressure in the supplemental-air system, however, can also be adjusted to convey the supplemental air supersonically if the blast pipes 13 are provided with Laval nozzles 16. In this event it is recommended to inject the supplemental air discontinuously and in pulses. Such pulses will last for example between 10 and 100 seconds and the intervening intervals between 30 and 300 seconds.

The additional poking will break up agglomerations, and the surface of the particles will be more effectively provided with primary air, which will in turn be exploited to better advantage. These results can be attained with relatively small volumes of supplemental air. The ratio of supplemental air to primary air by volume can very well be 1:10 to 1:100 and preferably 1:10 to 1:30. When the ratio is 1:20 for example and the supplemental air is enriched 30% with oxygen, oxygen demand will be less than 0.6 of the primary air by volume.

Another advantage of the present invention is that less ash will fall through the nips.

We claim:

1. A roller grate arrangement for a garbage-incinerating plant, comprising: a roller grate comprising a plurality of rollers with horizontal and parallel axes lying in an inclined plane; a layer of fuel disposed on said rollers; air boxes disposed below the grate, said air boxes forming a first system for feeding primary air to the interiors of said rollers; said rollers having surfaces with air gaps for transmitting the primary air; said rollers being spaced from each other, a space being formed between any two adjacent rollers; a component disposed in each said space between adjacent rollers and bridging said space between adjacent rollers; said component being free of air passages; a blast pipe positioned in at least some of said spaces between adjacent rollers; each said blast pipe being parallel to said axes of said rollers; each said blast pipe connected to a second system for feeding supplemental air to the layer of fuel; each said blast pipe having blast openings and being located in a main combustion zone of the incineration plant.

2. A roller grate arrangement as defined in claim 1, wherein a total cross-section of blast pipe openings per meter of blast-pipe length is within a range of 0.5 $cm^2$ to 10 $cm^2$.

3. A roller grate arrangement as defined in claim 1, wherein a total cross-section of blast openings per meter of blast-pipe length is less than 5 $cm^2$.

4. A roller grate arrangement as defined in claim 1, including holder means for securing a blast pipe to a corresponding component.

5. A roller grate arrangement as defined in claim 1, wherein each said blast pipe is rotatable about an axis.

6. A roller grate arrangement as defined in claim 1, wherein said blast openings comprise Laval nozzles.

7. A roller grate arrangement as defined in claim 1, wherein said blast openings are all simultaneously closeable.

8. A roller grate arrangement as defined in claim 1, wherein said blast openings are individually closeable.

9. A roller grate arrangement as defined in claim 1, including valving means between each said blast pipe and said separate system for feeding supplemental air; and a timer for controlling said valving means.

10. A roller grate arrangement as defined in claim 1, wherein said separate system for feeding supplemental air feeds oxygen-enriched air.

11. A roller grate arrangement as defined in claim 10, wherein said oxygen-enriched air is enriched with 25% to 50% oxygen.

12. A roller grate arrangement for a garbage-incinerating plant, comprising: a roller grate comprising a plurality of rollers with horizontal and parallel axes lying in an inclined plane; a layer of fuel on said rollers; air boxes disposed below the grate and forming a system for feeding primary air to the interiors of said rollers; said rollers having surfaces with air gaps for supplying the primary air; said rollers being spaced from each other, a space being formed between adjacent rollers; a component disposed in said space between adjacent rollers and bridging said space between adjacent rollers, said component being free of air passages; a blast pipe positioned in each said space between adjacent rollers; each said blast pipe being parallel to said axes of said rollers; each said blast pipe connected to a separate system for feeding supplemental air; each said blast pipe having blast openings and being located in a main combustion zone of said garbage incinerating plant; said component forming an air-tight closure beneath said grate; each said blast pipe lying in a space between said rollers within a garbage bed and being completely surrounded by the garbage bed; said supplemental air being introduced directly into the garbage bed, whereby contact between the air and combustible particles in the garbage is established.

13. A roller grate arrangement for a garbage-incinerating plant, comprising: a roller grate comprising a plurality of rollers with horizontal and parallel axes lying in an inclined plane; a layer of fuel on said rollers; air boxes below the grate and forming a system for feeding primary air to the interiors of said rollers; said rollers having surfaces with air gaps for supplying the primary air; said rollers being spaced from each other, a space being formed between adjacent rollers; a component disposed in said space between adjacent rollers and bridging said space between adjacent rollers, said component being free of air passages; a blast pipe positioned in each said space between adjacent rollers; each said blast pipe being parallel to said axes of said rollers; each said blast pipe connected to a separate system for feeding supplemental air; each said blast pipe having blast openings and being located in a main combustion zone of said garbage-incinerating plant; said component forming an air-tight closure beneath said grate; each said blast pipe lying in a space between said rollers within a garbage bed and being completely surrounded by the garbage bed, said supplemental air being introduced directly into the garbage bed such that contact between the air and combustible particles in the garbage is established; a total cross-section of blast pipe openings per meter of blast-pipe length being within a range of 0.5 $cm^2$ to 10 $cm^2$; holder means for securing each said blast pipe to a corresponding said component; each said blast pipe being rotatable about an axis of each said blast pipe; said blast openings comprising Laval nozzles; said blast openings all simultaneously closable; valving means between each said blast pipe and said separate system for feeding supplemental air; timer for controlling said valving means; said separate system for feeding supplemental air providing oxygen-enriched air with 25% to 50% oxygen enrichment.

* * * * *